US006685018B1

(12) United States Patent
Chuan

(10) Patent No.: US 6,685,018 B1
(45) Date of Patent: Feb. 3, 2004

(54) DISPLAY CASE, CARRY CASE AND STORAGE STAND FOR A PLURALITY OF ELONGATED TOOLS

(75) Inventor: Tseng Yi Chuan, Feng Yuan (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

(21) Appl. No.: 10/193,628

(22) Filed: Jul. 10, 2002

(51) Int. Cl.[7] ..... B65D 85/28
(52) U.S. Cl. ..... 206/373; 206/379; 206/749
(58) Field of Search ..... 206/372, 373, 206/349, 379, 745, 747, 749, 756, 759, 766; 211/70.6

(56) References Cited

U.S. PATENT DOCUMENTS 4,273,249 A * 6/1981 Florian ..... 220/4.25
4,819,800 A * 4/1989 Wilson ..... 206/373
5,524,915 A * 6/1996 Liu ..... 280/30
6,129,229 A * 10/2000 Dunn et al. ..... 220/4.22
6,375,007 B1 * 4/2002 Huang ..... 206/373
6,415,924 B1 * 7/2002 Lee ..... 206/459.5

* cited by examiner

*Primary Examiner*—Shian Luong
(74) *Attorney, Agent, or Firm*—Jack C. Munro

(57) ABSTRACT

A display case, carry case and storage stand for a plurality of elongated tools, such as screwdrivers, which comprises a pair of units which are pivotally connected together. Each unit has an exterior arcuate surface on which is to be mounted a plurality of the elongated tools in a spaced apart arrangement. The units are to be pivotable from an aligned position to a side-by-side position, and when in the side-by-side position the display case becomes a storage stand. When the display case is in the aligned position, it can function as a carry case.

3 Claims, 5 Drawing Sheets

DISPLAY CASE, CARRY CASE AND STORAGE STAND FOR A PLURALITY OF ELONGATED TOOLS

BACKGROUND OF THE INVENTION

1. Field of the Invention

The field of this invention relates to product packages and more particularly to a product package for a plurality of elongated tools that can attractively display the tools at a for sale location within a retail store and also where the purchaser of the package then can subsequently use the package as a carry case and a storage stand.

2. Description of the Related Art

The design of display packages for products within retail stores has long been known. When the product that is being made available for sale constitutes a set of tools, such as a set of screwdrivers, it has been known to display the screwdrivers within a carry case that resemble an attache case. Therefore, when the purchaser purchases the product, the display case will also become a carry case for the user.

There is always a need to design a new and novel arrangement for displaying of product that is to be purchased within a retail store, and if that display can then be functionally used by the purchaser of the product, such further use of the display will also function as an incentive to induce the purchaser to purchase the product.

SUMMARY OF THE INVENTION

A first basic embodiment comprising a display case, carry case and storage stand for a plurality of elongated tools which comprises a first unit which has a first front surface extending from a first rear surface. The first front surface is generally arcuate and has a series of first tool engagements located in a spaced apart arrangement. Each first tool engagement is adapted to supportingly mount an elongated tool. The second unit having a front surface extends from a second rear surface. The second front surface is also generally arcuate and also has a series of second tool engagements located in a spaced apart unit. Each second tool arrangement is adapted to supportingly mount an elongated tool. The first unit and second unit are hingedly connected together which permits the first unit to be located in an aligned position with the second unit or in a side abutting position with the second unit.

A further embodiment of the present invention is where the first basic embodiment utilizes a series of slots as both the first tool engagements and the second tool engagements.

A further embodiment of the present invention is where the just previous embodiment is modified by the tools when mounted within the slots being located parallel to the longitudinal center axis of the display case when in the aligned position.

A further embodiment of the present invention is where the first basic embodiment is modified by the second unit being similar in overall configuration to the first unit.

A further embodiment of the present invention is where the first basic embodiment is modified by forming a storage container in conjunction with the storage stand configuration of the present invention.

A further embodiment of the present invention is where the first basic embodiment is modified by the first unit being latched to the second unit when both in the aligned position and in the side abutting position.

A second basic embodiment of the present invention is directed to a method of marketing a plurality of elongated tools which comprises placing and storing the tools on a two-part display case where one part is pivotally movable relative to a second part between an aligned position and a side-by-side position. When in the aligned position there is provided a handle attached to the display case which facilitates carrying the display case. When in the side-by-side position, the display case functions as a stand for a table or counter providing a centrally located storage container into which tools may be located.

A further embodiment of the present invention is where the second basic embodiment is modified by having the one part to be hingedly connected to the second part.

A further embodiment of the present invention is where the second basic embodiment is modified by both the first part and second part including a series of tool mounting slots.

A further embodiment of the present invention is where the second basic embodiment is modified by the including of a locking arrangement between one part and the second part when in both the aligned position and the side-by-side position.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
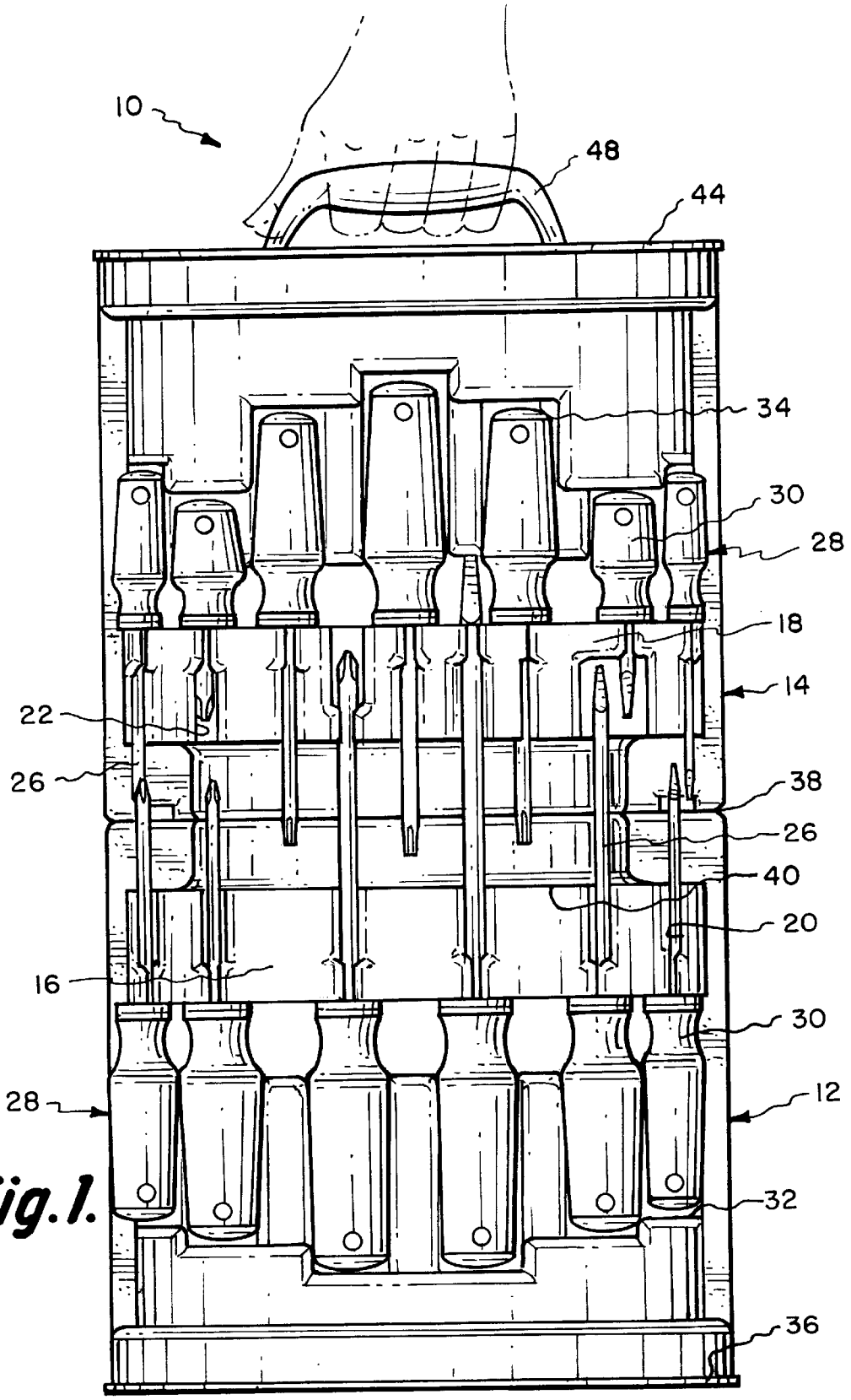
FIG. 1 is a side elevational view of the display case, carry case and storage stand of the present invention showing the invention in the aligned position where it can function as a carry case which is also the position of the display case.
Figure 2:
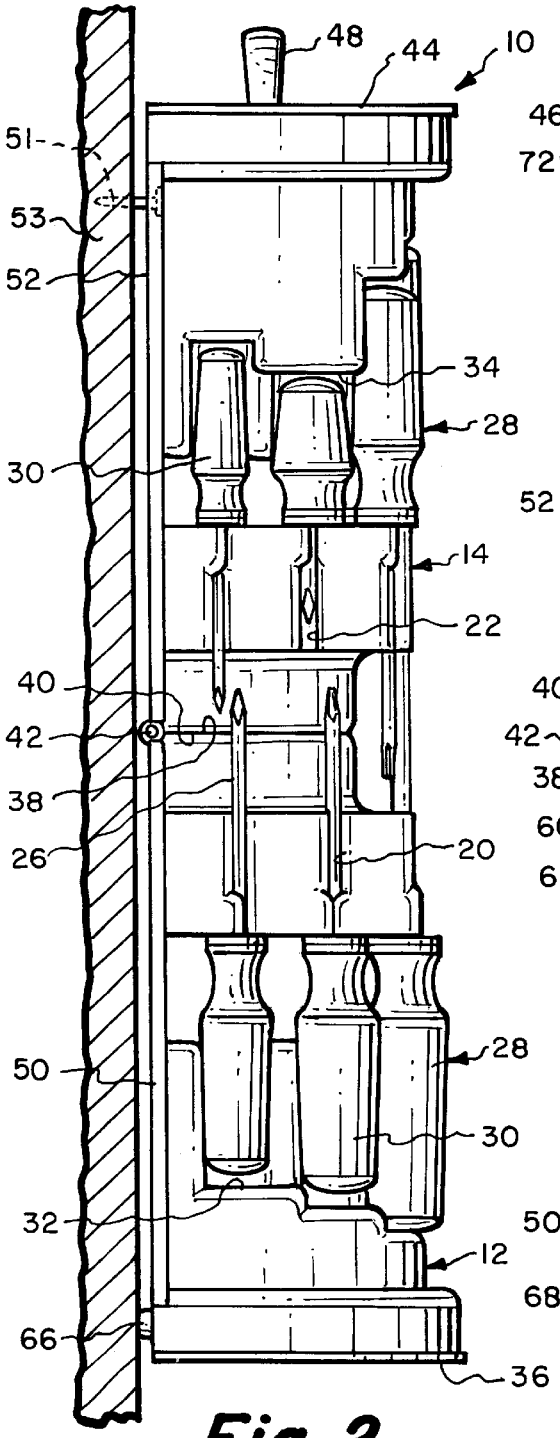
FIG. 2 is a left side elevational view of the carry case shown in FIG. 1.
Figure 4:
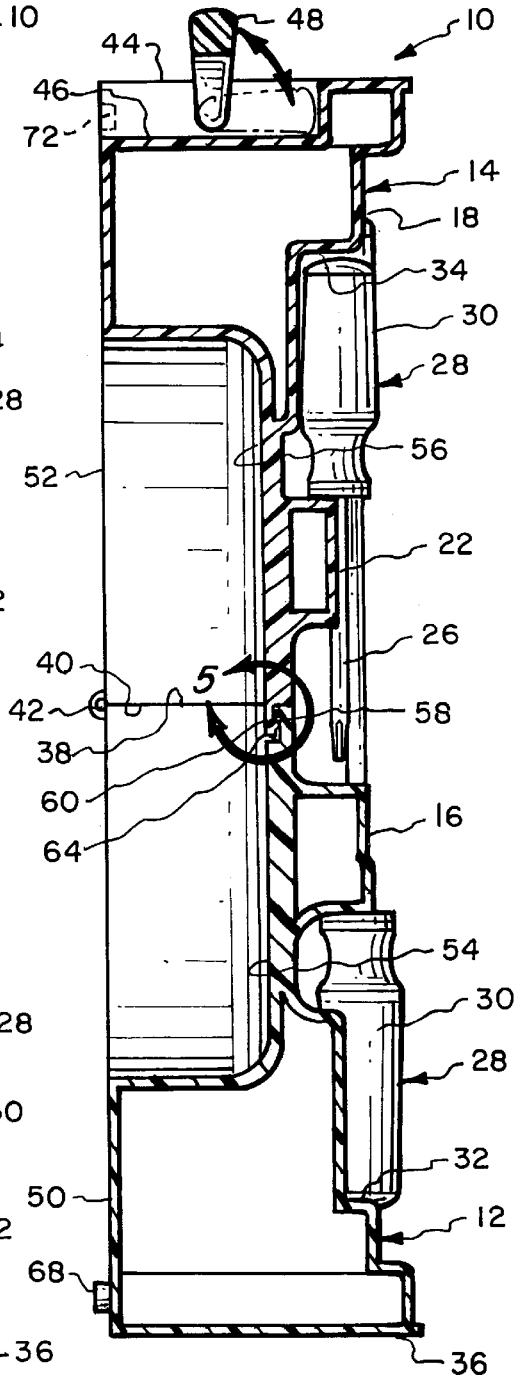
FIG. 4 is a longitudinal cross-sectional view through the display case and carry case of the present invention taken along 4—4 of FIG. 3.
Figure 3:
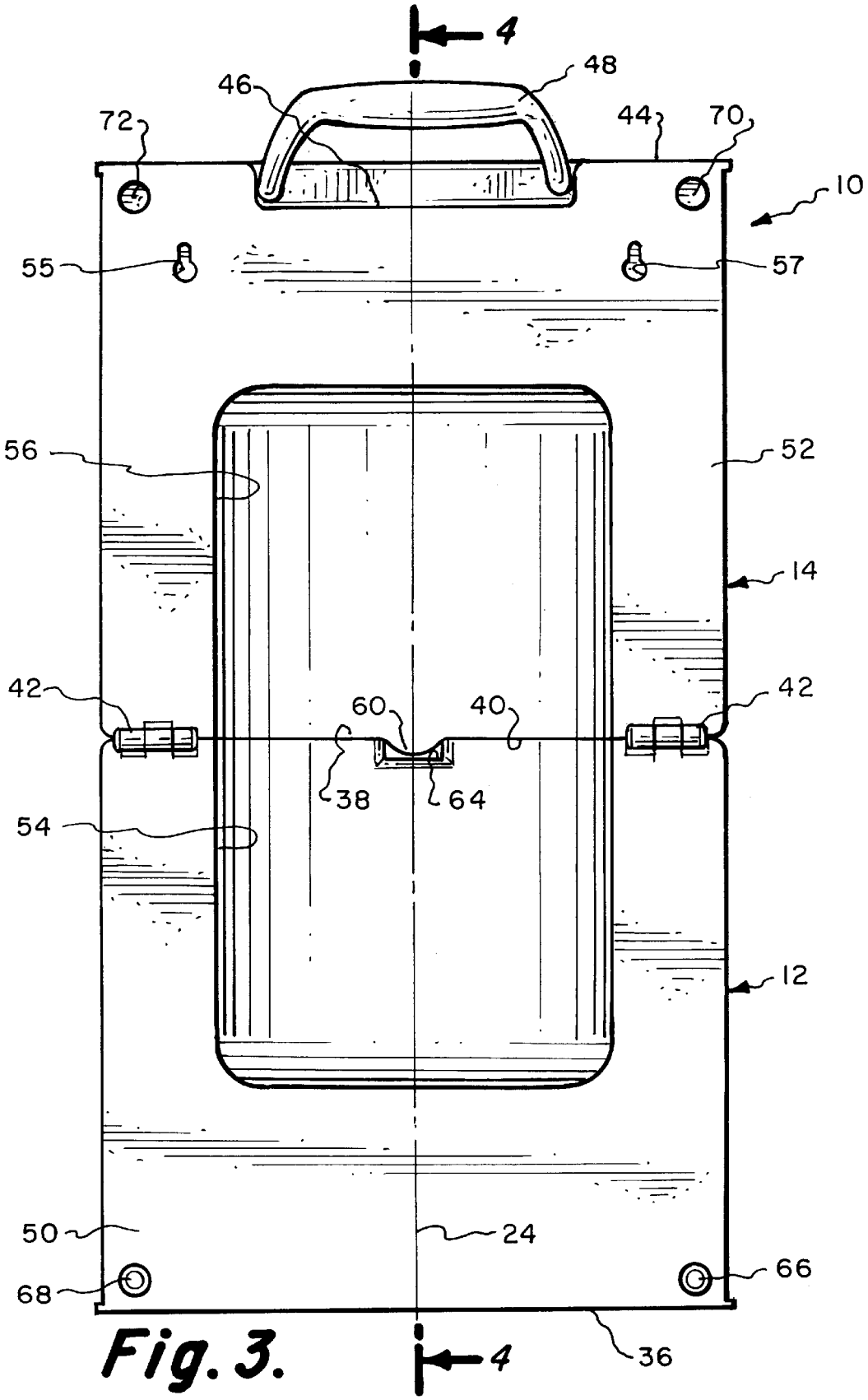
FIG. 3 is a rear elevational view of the display case and carry case of the present invention.
Figure 5:
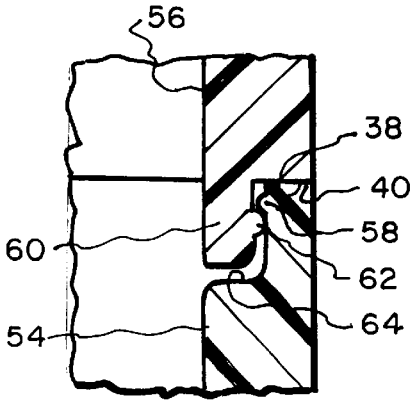
FIG. 5 is an enlarged cross-sectional view showing the latching structure between the pair of units when in the aligned position of the display case and carry case of the present invention showing the latch in the latched position.
Figure 7:
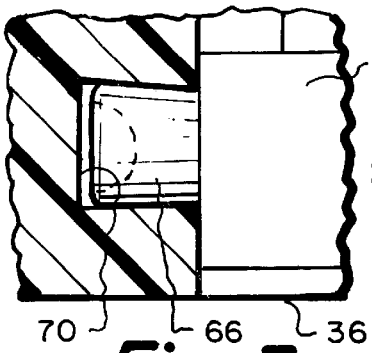
FIG. 7 is an enlarged cross-sectional view taken along line 7—7 of FIG. 6 showing in more detail the latching arrangement between the units when in the storage stand configuration.

Referring particularly to the drawings, there is shown the display case, carry case and storage stand 10 of the present invention, hereinafter referred to as case 10. Case 10 is constructed of a pair of units or parts known as a first unit 12 and a second unit 14. The units 12 and 14 are similar in overall construction. However, units 12 and 14 are not identical. Units 12 and 14 will be constructed of a plastic material. However, it is considered to be within the scope of this invention that other materials could be used.

Unit 12 has a first front surface 16. Second unit 14 has a second front surface 18. Both front surfaces 16 and 18 are basically arcuate and are actually shown to be a segment of a circle. However, it is considered to be within the scope of this invention that the term arcuate is to refer to any outwardly bowed configuration. For example, the front surfaces 16 and 18 could each comprise a segment of an octagon or hexagon or could be a segment of an ellipse.

The first front surface 16 includes a series of spaced apart open ended slots 20. The second unit 14 also includes a series of open ended slots 22. The slots 20 are all parallel to each other and the slots 22 are all parallel to each other. There are nine in number of the slots 20 with a similar number for the slots 22. When the first unit 12 and the second unit 14 are located in an aligned configuration, which is shown in FIGS. 1–4 of the drawings, the longitudinal axis of each of the slots 20 and 22 is located parallel to the longitudinal axis 24 of the case 10. The slots 20 and 22 may or may not be evenly spaced apart. The width of the slots 20 and 22 may vary slightly. The purpose of each of the slots 20 and 22 is to provide a snapping, securing engagement with the shaft 26 of an elongated tool 28. The tool 28 that is shown is screwdrivers of different lengths and different sizes. The shaft 26 is attached to a handle 30 which is part of the tool 28. There is to be a particular slot 22 or 24 for a particular length and size of tool 28. The first front surface 16 will include a series of ledges 32, and the second surface 18 also includes a similar set of ledges 34. The closer the ledge 32 is to the first bottom edge 36 of the first unit 12, the longer the tool 28 that is mounted in conjunction with the first front surface 16. The farther a ledge 32 is from the bottom edge 36, the shorter in length the tool 28 that is mounted in conjunction with one of the slots 20. The same is also true relative to slots 22 of the second unit 14.

The first unit 12 has a first top edge 38. The second unit 14 also has a second top edge 40. When the first unit 12 is in alignment with the second unit 14, the top edges 38 and 40 abut one another. Located between the top edges 38 and 40 are a pair of hinges 42. It is the hinges 42 that will permit the second unit 14 to be pivoted about one-hundred and eighty degrees from the aligned position, shown in FIGS. 1 and 4, to the side-by-side or side abutting position, shown in FIGS. 6 and 8 of the drawings.

The second unit 14 also has a second bottom edge 44. Formed within the second bottom edge 44 is a handle cavity 46. Pivotally mounted within the handle cavity 46 is a handle 48. The handle 48 can be moved to the upwardly extended position, as shown in solid lines in FIG. 4, or assume the retraced position within the handle cavity 46, as is shown in dotted line positions of FIG. 4. The purpose of the handle 48 is to facilitate carrying the case 10 of this invention when the first unit 12 and the second unit 14 are in the aligned position, as is shown in FIGS. 1–4. This carrying of the case 10 is to be accomplished by the user of the case 10.

Figure 6:
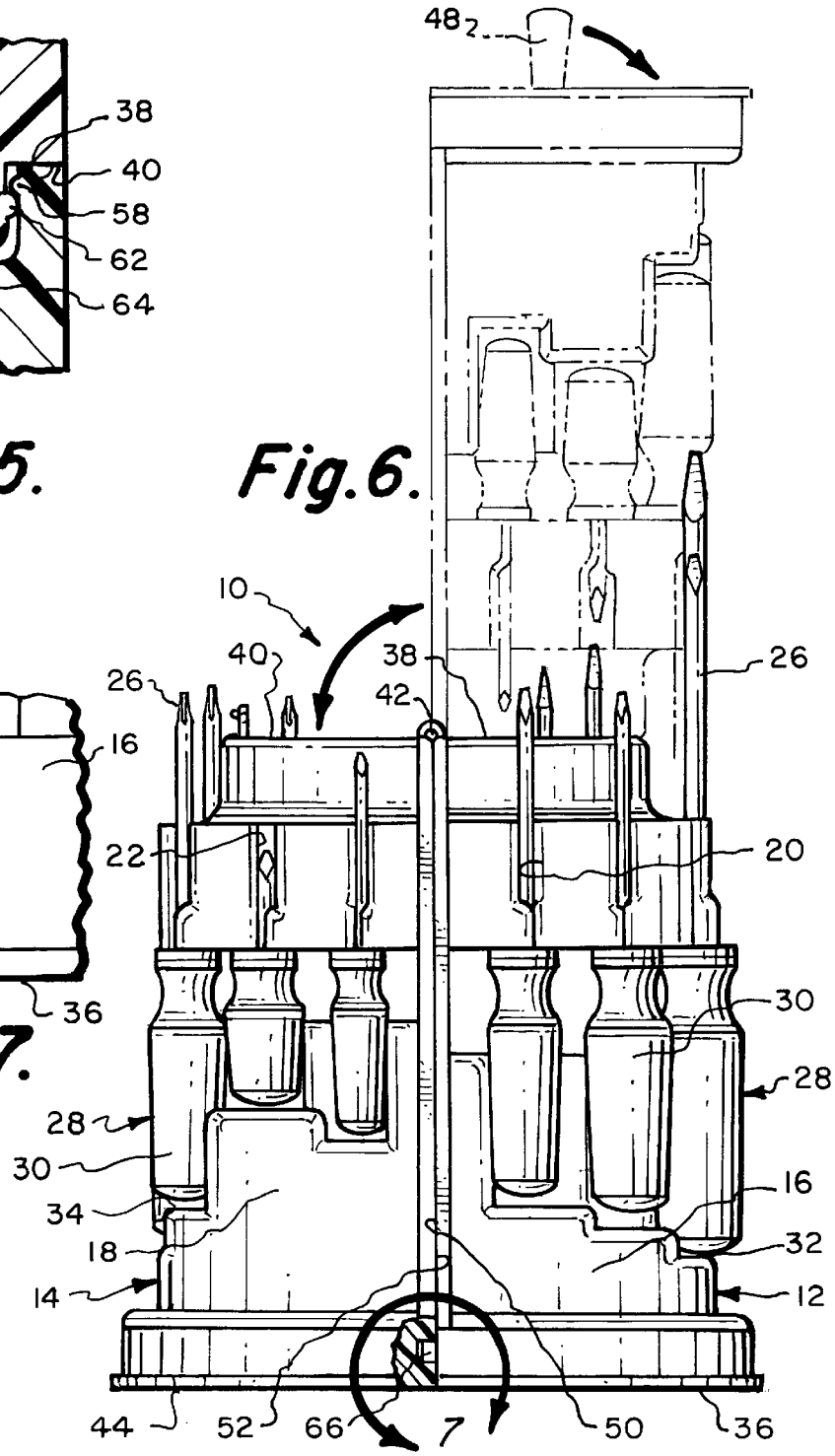
FIG. 6 is a side elevational view of the display case, carry case and storage stand of the present invention depicting movement of one unit relative to another unit and showing the storage stand configuration in solid lines.
Figure 8:
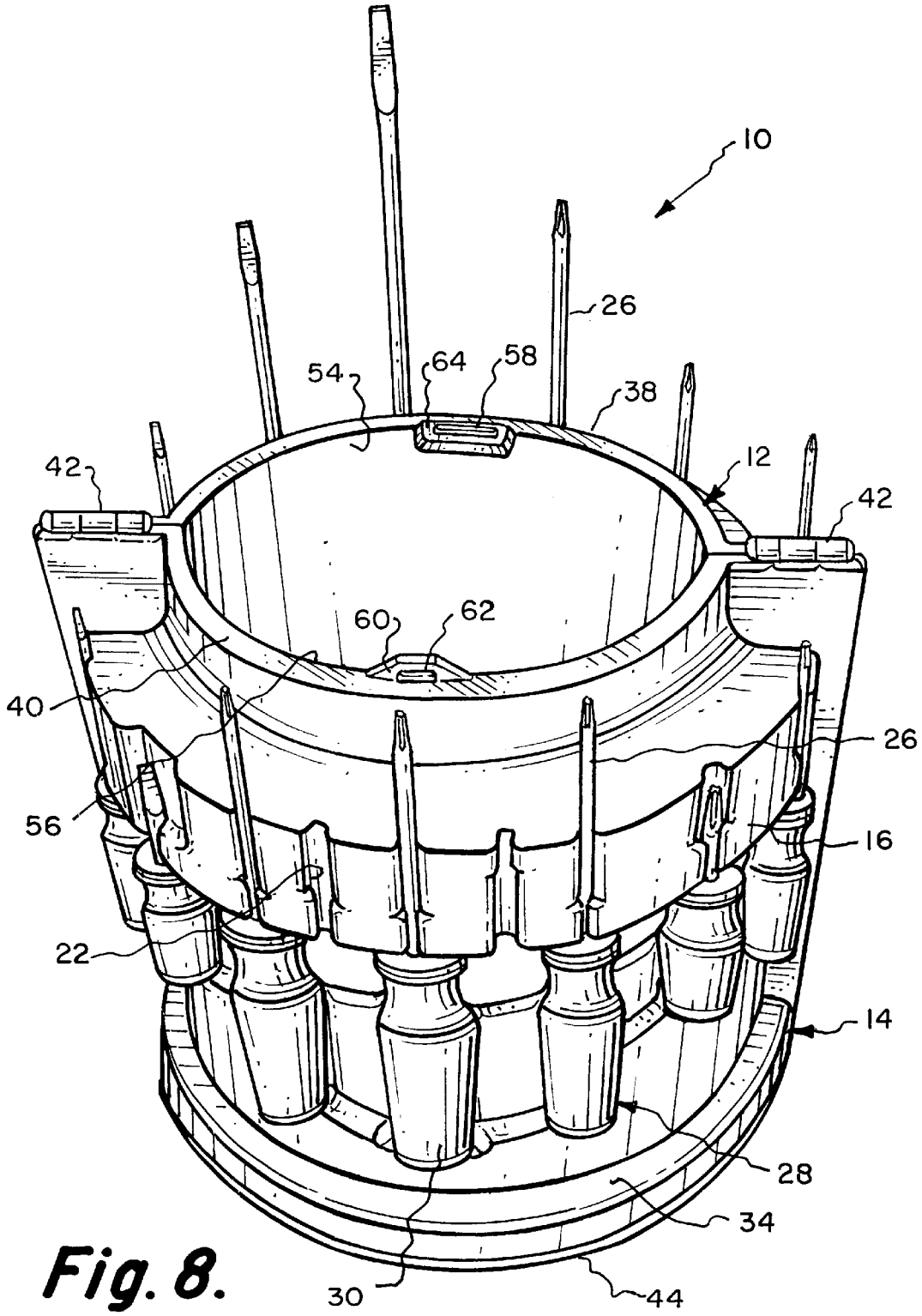
FIG. 8 is an isometric view of the storage stand configuration of the present invention.

The first unit 12 has a first rear surface 50 and the second unit 14 has a second rear surface 52. Generally, the rear surfaces 50 and 52 are planar with the exception that the first rear surface 50 includes a first enlarged cavity 54 and the second rear surface 52 includes a similarly sized second enlarged cavity 56. The cavities 54 and 56 cooperate together to form a single container, similar to a bucket. This container is formed when the case 10 is in the stand configuration, as is shown in FIGS. 6 and 8. This container can be used by the user when a tool 28 is disengaged from its respective slot 20 or 22 with the tool to be merely placed shaft 26 first within this container with storage of the tools 28 to occur in that particular manner. Some users may not want to store the tools 28 by reinserting them in conjunction with their respective slots 20 and 22. In actual practice when observing FIG. 8, once the case 10 has moved to the stand position, as shown in FIG. 8, the user should at least remove the tools 28 from their respective slots and turn such one-hundred and eighty degrees around. This will be so that the relatively sharp pointed shaft 26 will not be extending in an upward direction but rather in a downward direction making it virtually impossible for anyone to be injured by contacting the shafts 26.

When the first unit 12 is in an aligned position with the second position 14, it is desired that there is incorporated a latching mechanism to hold the units 12 and 14 in this aligned position. This latching mechanism takes the form of a protuberance 58 which is mounted on the wall surface of the first enlarged cavity 54. Mounted on the second top edge 40 is an extension 60 which has formed thereon a protuberance 62. The protuberance 58 is actually formed within a cavity 64 formed within the wall surface of the first enlarged cavity 54. When the units 12 and 14 are mounted to the aligned position, the protuberance 62 will override protuberance 58 with a snapping action occurring thereby locking together the units 12 and 14. However, upon the application of a small amount of manual force, the second unit 14 can be disengaged from the first unit 12 and moved to the side-by-side or side abutting position, shown in FIGS. 6 and 8 of the drawings. When in this side-by-side position, there is formed a pair of pins 66 and 68 on the first rear surface 50. Formed on the second rear surface 52 are a pair of spaced apart holes 70 and 72. Pin 66 is to snap tightly into the hole 70 and pin 68 is to snap tightly into the hole 72 when the units 12 and 14 are located in the side-by-side position. However, again from the application of a separating manual force of a slight amount, the units 12 and 14 can be disengaged from the side-by-side position. The pins 66 and 68 and holes 70 and 72 constitute one latching mechanism. Protuberances 58 and 62 constitute a second latching mechanism.

With the units 12 and 14 in the aligned position, as shown in FIGS. 1–4 of the drawings, the case 10 can be readily placed within a display package and displayed in a retail store for sale. After the display package (which is not shown) is removed from the case 10, the user can use the case 10 as a carry case by carrying the case 10 by the handle 48. Typically, this will be used by the user to go from job location to job location where the user can carry the entire series of screwdriver type tools 28, or other types of tools, and have them available for usage. Also, the carry case can be mounted by a pair of nails 51 to a wall 53. One nail 51 connects with hole 55 and the other nail 51 connects with hole 57 formed on second rear surface 52. When the case 10 of this invention is in the stand position, as shown in FIGS. 6 and 8, generally the stand can be placed on a tool bench, table, counter or other type of supporting surface and its function is to merely store the tools 28 but yet make them readily available for use when such is desired.

What is claimed is:

1. A display case, carry case and storage stand for a plurality of elongated tools comprising:

a first unit having a first front surface extending from a first rear surface, said first front surface being generally arcuate and having a series of first tool engagements located in a spaced apart arrangement, each said first tool engagement adapted to supportingly mount an elongated tool, said first unit having a first top edge and a first bottom edge;

a second unit having a second front surface extending from a second rear surface, said second front surface being generally arcuate and having a series of second tool engagements located in a spaced apart arrangement, each said second tool engagement adapted to supportingly mount an elongated tool, said second unit having a second top edge and a second bottom edge;

said first top edge being hingedly connected to said second top edge which permits said second unit to be moved between an aligned position and a side abutting position, said aligned position locates said second unit in longitudinal alignment with said first unit, said side abutting position locates said second unit alongside said first unit; and said first unit having a first concavity formed within said first rear surface, said second unit having a second concavity formed within said second rear surface, said first concavity cooperating with said second concavity when in said side abutting position forming a storage container for said elongated tools when such are not connected with said first tool engagements and said second tool engagements.

2. A display case, carry case and storage stand for a plurality of elongated tools comprising:

a first unit having a first front surface extending from a first rear surface, said first front surface being generally arcuate and having a series of first tool engagements located in a spaced apart arrangement, each said first tool engagement adapted to supportingly mount an elongated tool, said first unit having a first top edge and a first bottom edge;

a second unit having a second front surface extending from a second rear surface, said second front surface being generally arcuate and having a series of second tool engagements located in a spaced apart arrangement, each said second tool engagement adapted to supportingly mount an elongated tool, said second unit having a second top edge and a second bottom edge;

said first top edge being hingedly connected to said second top edge which permits said second unit to be moved between an aligned position and a side abutting position, said aligned position locates said second unit in longitudinal alignment with said first unit, said side abutting position locates said second unit alongside said first unit; and a means for locking that engages between said first unit and said second unit when in either said aligned position or said side abutting position.

3. The method of marketing a plurality of elongated tools comprising:

placing and storing of said tools on a two part display case where one part is pivotally mountable and movable relative to a second Dart between an aligned position and a side-by-side position;

when in said aligned position there is provided a handle attached to said display case which facilitates carrying of said display case;

when in said side-by-side position said display case functions as a stand for a table or counter providing a centrally located storage container into which said tools may be located; and including a means for locking between said one part and said second part.

* * * * *